US010486417B2

(12) United States Patent
Tsushima et al.

(10) Patent No.: US 10,486,417 B2
(45) Date of Patent: Nov. 26, 2019

(54) PRINTING APPARATUS

(71) Applicant: CANON KABUSHIKI KAISHA, Tokyo (JP)

(72) Inventors: Ippei Tsushima, Kawasaki (JP); Ryosuke Sato, Kawasaki (JP); Yusuke Nakaya, Inagi (JP); Toshiki Takeuchi, Tokyo (JP); Kengo Nieda, Kawasaki (JP); Kenji Sugiyama, Kawasaki (JP); Futoshi Hirose, Yokohama (JP); Atsushi Sakamoto, Yokohama (JP); Susumu Hirosawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/026,293

(22) Filed: Jul. 3, 2018

(65) Prior Publication Data

US 2019/0016112 A1 Jan. 17, 2019

(30) Foreign Application Priority Data

Jul. 12, 2017 (JP) ..... 2017-136444

(51) Int. Cl.

| | |
|---|---|
| ***B41J 2/005*** | (2006.01) |
| ***B41J 29/17*** | (2006.01) |
| ***B41J 2/22*** | (2006.01) |
| ***B41J 2/245*** | (2006.01) |
| *B41J 2/01* | (2006.01) |

(52) U.S. Cl.

CPC ..... *B41J 2/0057* (2013.01); *B41J 2/22* (2013.01); *B41J 2/245* (2013.01); *B41J 29/17* (2013.01); *B41J 2002/012* (2013.01)

(58) Field of Classification Search

CPC ... B41J 2/0057; B41J 2/22; B41J 2/245; B41J 2002/012; B41J 29/17

See application file for complete search history.

(56) References Cited

U.S. PATENT DOCUMENTS

| | | | | |
|---|---|---|---|---|
| 8,231,216 | B2 | 7/2012 | Yamamuro et al. | |
| 2006/0232624 | A1* | 10/2006 | Inoue | B41J 3/44 347/23 |
| 2011/0141188 | A1* | 6/2011 | Morita | B41J 2/0057 347/20 |
| 2018/0250930 | A1 | 9/2018 | Sato et al. | |

(Continued)

FOREIGN PATENT DOCUMENTS

JP 2009-149019 A 7/2009

*Primary Examiner* — Geoffrey S Mruk
(74) *Attorney, Agent, or Firm* — Venable LLP

(57) ABSTRACT

A printing apparatus includes a transfer member that rotates, a printhead that forms an image on the transfer member, and a transfer unit that transfers the image to a print medium. An application unit, provided at a downstream side of an area, at which the transfer unit transfers the image to the print medium, in a rotation direction of the transfer member, applies a cleaning liquid to a region on the transfer member after the image is transferred to the print medium. In addition, a collecting unit, provided between the printhead and the application unit, in the rotation direction of the transfer member, includes a collection roller that rotates in contact with the transfer member, in a direction opposite to the rotation direction of the transfer member, for collecting the cleaning liquid applied to the transfer member by the application unit.

13 Claims, 9 Drawing Sheets

(56) References Cited

U.S. PATENT DOCUMENTS

| | | | |
|---|---|---|---|
| 2018/0250967 | A1 | 9/2018 | Sato et al. |
| 2018/0257369 | A1 | 9/2018 | Takeuchi |
| 2018/0311951 | A1 | 11/2018 | Sakamoto et al. |
| 2018/0326719 | A1 | 11/2018 | Masuda et al. |
| 2018/0326755 | A1 | 11/2018 | Ohnishi et al. |
| 2019/0009546 | A1 | 1/2019 | Sakamoto et al. |
| 2019/0009594 | A1 | 1/2019 | Sakamoto et al. |
| 2019/0009600 | A1 | 1/2019 | Moriguchi et al. |

* cited by examiner

PRINTING APPARATUS

BACKGROUND OF THE INVENTION

Field of the Invention

The present invention relates to an inkjet printing apparatus that transfers, to a print medium, an image formed by discharging ink to a transfer member.

Description of the Related Art

There is an inkjet printing apparatus configured to discharge ink to an intermediate transfer member from a printhead, form an image on the intermediate transfer member, transfer the image to a print medium, and print the image. Japanese Patent Laid-Open No. 2009-149019 discloses an arrangement that includes an image forming unit using an inkjet printhead, a transfer unit for transferring an image to a print medium, a wiping unit for wiping and cleaning the transfer member, and the like around an intermediate transfer member (also simply referred to as a transfer member). This applies a liquid (cleaning liquid) onto the transfer member, scrapes it off by a cleaning blade, and collects it.

However, if the surface of the transfer member is wiped by using the cleaning blade as in Japanese Patent Laid-Open No. 2009-149019, a shear force is generated when the cleaning blade contacts the transfer member while being deformed. This speeds up deterioration of the cleaning blade and increases a maintenance frequency such as the replacing operation of the cleaning blade. In addition, damage to the transfer member from the cleaning blade is large, increasing a maintenance frequency of the transfer member.

SUMMARY OF THE INVENTION

Accordingly, the present invention is conceived as a response to the above-described disadvantages of the conventional art.

For example, an inkjet printing apparatus according to this invention is capable of collecting a liquid applied to a transfer member efficiently and maintaining the state of the transfer member satisfactorily.

According to one aspect of the present invention, there is provided a printing apparatus comprising: a transfer member that rotates; a printhead configured to form an image on the transfer member; a transfer unit configured to transfer, to a print medium, the image formed on the transfer member; an application unit configured to apply a liquid to a region on the transfer member after the image is transferred to the print medium; and a collecting unit configured to include a collection roller, that rotates in contact with the transfer member, for collecting the liquid applied to the transfer member by the application unit.

The invention is particularly advantageous since an inkjet printing apparatus capable of collecting a liquid applied to a transfer member efficiently by a collection roller and maintaining the state of the transfer member satisfactorily is realized.

Further features of the present invention will become apparent from the following description of exemplary embodiments (with reference to the attached drawings).

DESCRIPTION OF THE EMBODIMENTS

Exemplary embodiments of the present invention will now be described in detail in accordance with the accompanying drawings. Note that arrows X and Y indicate the horizontal directions, respectively, the arrows X and Y are perpendicular to each other in each figure, and arrow Z indicates the vertical direction.

<Description of Terms>

In this specification, the terms "print" and "printing" not only include the formation of significant information, such as characters and graphics, but also broadly include the formation of images, figures, patterns, and the like on a print medium, or the processing of the medium, regardless of whether they are significant or insignificant and regardless of whether they are so visualized as to be visually perceivable by humans.

Also, the term "print medium (or sheet)" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium. Note that this invention is not limited to any specific ink component, however, it is assumed that this embodiment uses water-base ink including water, resin, and pigment serving as coloring material.

Further, a "print element (or nozzle)" generally means an ink orifice or a liquid channel communicating with the ink orifice, and an element for generating energy used to discharge ink, unless otherwise specified.

An element substrate for a printhead (head substrate) used below means not merely a base made of a silicon semiconductor, but an arrangement in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

<Printing System>

Figure 1:
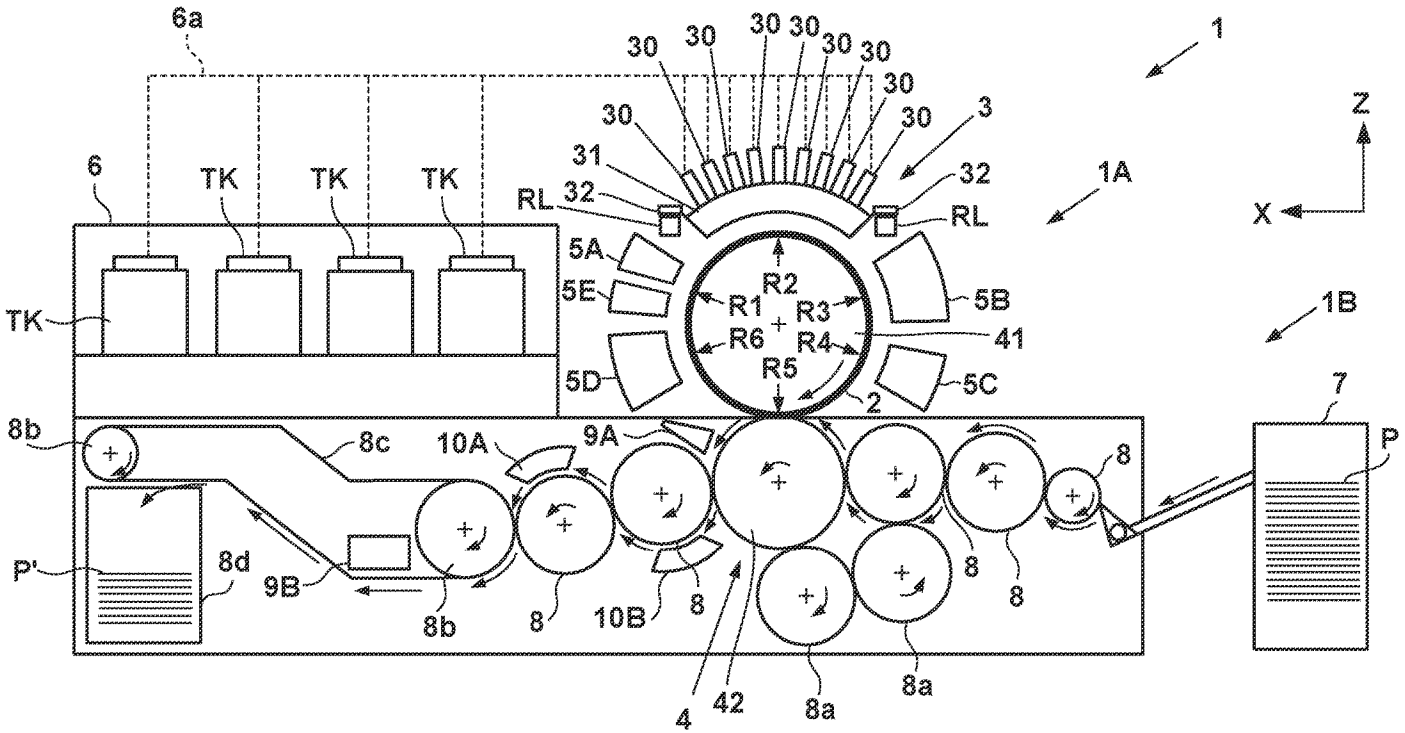
FIG. 1 is a schematic view showing a printing system according to an exemplary embodiment of the present invention.

FIG. 1 is a front view schematically showing a printing system 1 according to an embodiment of the present invention. The printing system 1 is a sheet inkjet printer that forms a printed product P' by transferring an ink image to a print medium P via a transfer member 2. The printing system 1 includes a printing apparatus 1A and a conveyance apparatus 1B. In this embodiment, an X direction, a Y direction, and a Z direction indicate the widthwise direction (total length direction), the depth direction, and the height direction of the printing system 1, respectively. The print medium P is conveyed in the X direction.

<Printing Apparatus>

The printing apparatus 1A includes a print unit 3, a transfer unit 4, peripheral units 5A to 5E, and a supply unit 6.

<Print Unit>

Figure 2:
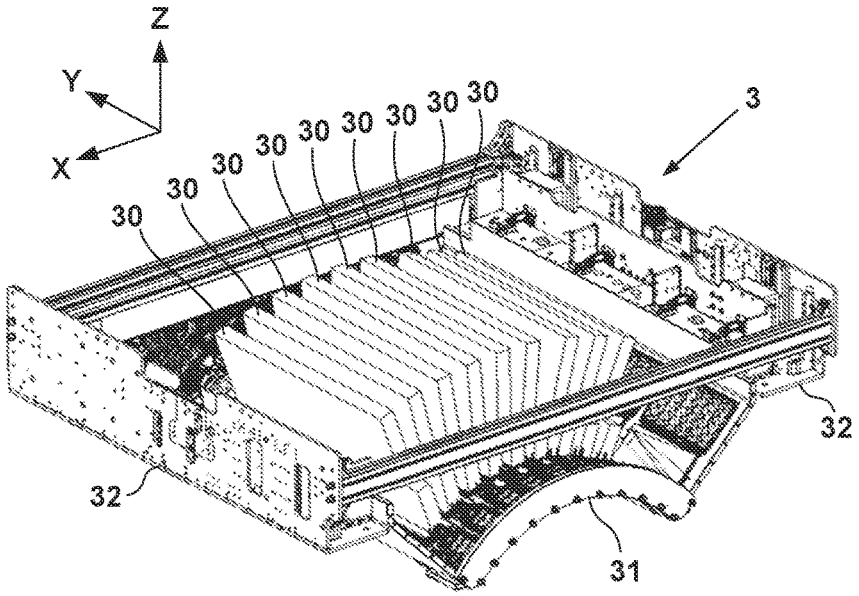
FIG. 2 is a perspective view showing a print unit.

The print unit 3 includes a plurality of printheads 30 and a carriage 31. A description will be made with reference to FIGS. 1 and 2. FIG. 2 is perspective view showing the print unit 3. The printheads 30 discharge liquid ink to the transfer member (intermediate transfer member) 2 and form ink images of a printed image on the transfer member 2.

In this embodiment, each printhead 30 is a full-line head elongated in the Y direction, and nozzles are arrayed in a range where they cover the width of an image printing area of a print medium having a usable maximum size. Each printhead 30 has an ink discharge surface with the opened nozzle on its lower surface, and the ink discharge surface faces the surface of the transfer member 2 via a minute gap (for example, several mm). In this embodiment, the transfer member 2 is configured to move on a circular orbit cyclically, and thus the plurality of printheads 30 are arranged radially.

Each nozzle includes a discharge element. The discharge element is, for example, an element that generates a pressure in the nozzle and discharges ink in the nozzle, and the technique of an inkjet head in a well-known inkjet printer is applicable. For example, an element that discharges ink by causing film boiling in ink with an electrothermal transducer and forming a bubble, an element that discharges ink by an electromechanical transducer (piezoelectric element), an element that discharges ink by using static electricity, or the like can be given as the discharge element. A discharge element that uses the electrothermal transducer can be used from the viewpoint of high-speed and high-density printing.

In this embodiment, nine printheads 30 are provided. The respective printheads 30 discharge different kinds of inks. The different kinds of inks are, for example, different in coloring material and include yellow ink, magenta ink, cyan ink, black ink, and the like. One printhead 30 discharges one kind of ink. However, one printhead 30 may be configured to discharge the plurality of kinds of inks. When the plurality of printheads 30 are thus provided, some of them may discharge ink (for example, clear ink) that does not include a coloring material.

The carriage 31 supports the plurality of printheads 30. The end of each printhead 30 on the side of an ink discharge surface is fixed to the carriage 31. This makes it possible to maintain a gap on the surface between the ink discharge surface and the transfer member 2 more precisely. The carriage 31 is configured to be displaceable while mounting the printheads 30 by the guide of each guide member RL. In this embodiment, the guide members RL are rail members elongated in the Y direction and provided as a pair separately in the X direction. A slide portion 32 is provided on each side of the carriage 31 in the X direction. The slide portions 32 engage with the guide members RL and slide along the guide members RL in the Y direction.

Figure 3:
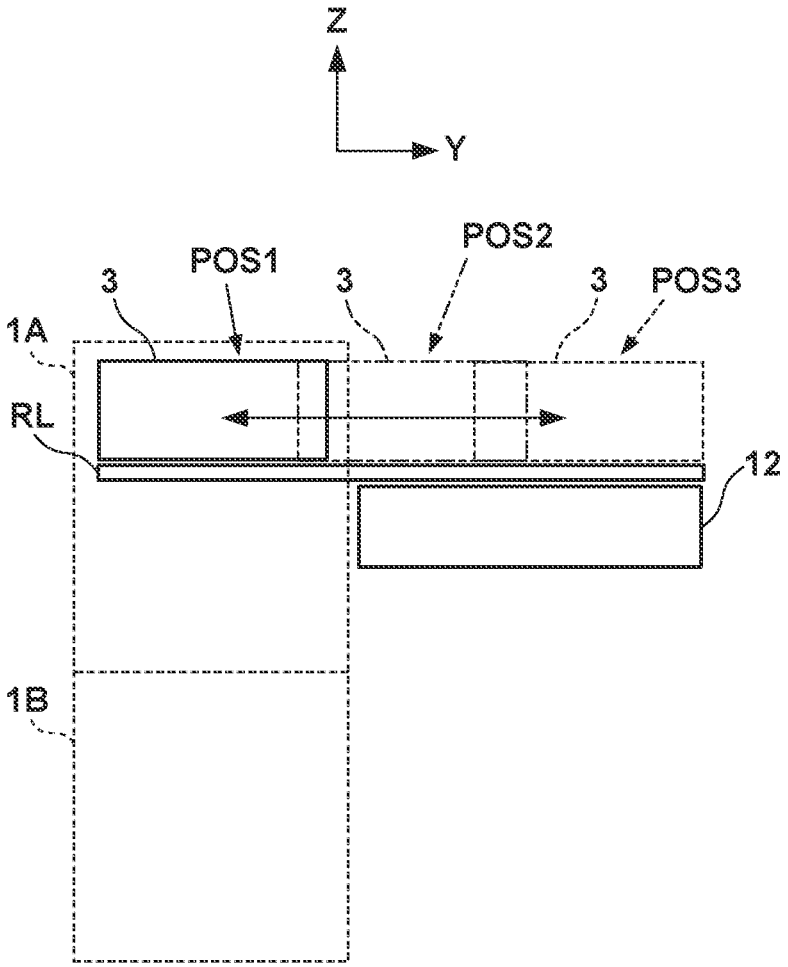
FIG. 3 is an explanatory view showing a displacement mode of the print unit in FIG. 2.

FIG. 3 is a view showing a displacement mode of the print unit 3 and schematically shows the right side surface of the printing system 1. A recovery unit 12 is provided in the rear of the printing system 1. The recovery unit 12 has a mechanism for recovering discharge performance of the printheads 30. For example, a cap mechanism which caps the ink discharge surface of each printhead 30, a wiper mechanism which wipes the ink discharge surface, a suction mechanism which sucks ink in the printhead 30 by a negative pressure from the ink discharge surface can be given as such mechanisms.

The guide member RL is elongated over the recovery unit 12 from the side of the transfer member 2. By the guide of the guide member RL, the print unit 3 is displaceable between a discharge position POS1 at which the print unit 3 is indicated by a solid line and a recovery position POS3 at which the print unit 3 is indicated by a broken line, and is moved by a driving mechanism (not shown).

The discharge position POS1 is a position at which the print unit 3 discharges ink to the transfer member 2 and a position at which the ink discharge surface of each printhead 30 faces the surface of the transfer member 2. The recovery position POS3 is a position retracted from the discharge position POS1 and a position at which the print unit 3 is positioned above the recovery unit 12. The recovery unit 12 can perform recovery processing on the printheads 30 when the print unit 3 is positioned at the recovery position POS3. In this embodiment, the recovery unit 12 can also perform the recovery processing in the middle of movement before the print unit 3 reaches the recovery position POS3. There is a preliminary recovery position POS2 between the discharge position POS1 and the recovery position POS3. The recovery unit 12 can perform preliminary recovery processing on the printheads 30 at the preliminary recovery position POS2 while the printheads 30 move from the discharge position POS1 to the recovery position POS3.

<Transfer Unit>

The transfer unit 4 will be described with reference to FIG. 1. The transfer unit 4 includes a transfer drum 41 and a pressurizing drum 42. Each of these drums is a rotating body that rotates about a rotation axis in the Y direction and has a columnar outer peripheral surface. In FIG. 1, arrows shown in respective views of the transfer drum 41 and the pressurizing drum 42 indicate their rotation directions. The transfer drum 41 rotates clockwise, and the pressurizing drum 42 rotates anticlockwise.

The transfer drum 41 is a support member that supports the transfer member 2 on its outer peripheral surface. The transfer member 2 is provided on the outer peripheral surface of the transfer drum 41 continuously or intermittently in a circumferential direction. If the transfer member 2 is provided continuously, it is formed into an endless swath. If the transfer member 2 is provided intermittently, it is formed into swaths with ends divided into a plurality of segments. The respective segments can be arranged in an arc at an equal pitch on the outer peripheral surface of the transfer drum 41.

The transfer member 2 moves cyclically in the circular orbit by rotating the transfer drum 41. By the rotational phase of the transfer drum 41, the position of the transfer member 2 can be discriminated into a processing area R1 before discharge, a discharge area R2, processing areas R3 and R4 after discharge, a transfer area R5, and a processing area R6 after transfer. The transfer member 2 passes through these areas cyclically.

The processing area R1 before discharge is an area where preprocessing is performed on the transfer member 2 before the print unit 3 discharges ink and an area where the peripheral unit 5A performs processing. In this embodiment, a reactive liquid is applied. The discharge area R2 is a formation area where the print unit 3 forms an ink image by discharging ink to the transfer member 2. The processing areas R3 and R4 after discharge are processing areas where processing is performed on the ink image after ink discharge. The processing area R3 after discharge is an area where the peripheral unit 5B performs processing, and the processing area R4 after discharge is an area where the peripheral unit 5C performs processing. The transfer area R5 is an area where the transfer unit 4 transfers the ink image on the transfer member 2 to the print medium P. The processing area R6 after transfer is an area where post processing is performed on the transfer member 2 after transfer and an area where the peripheral unit 5D performs processing.

Note that a peripheral unit 5E is provided between the processing area R1 before discharge and the processing area R6 after transfer, and cooling of the transfer member 2 is performed by applying a cooling liquid and collecting it from the peripheral unit 5E.

In this embodiment, the discharge area R2 is an area with a predetermined section. The other areas R1 and R3 to R6 have narrower sections than the discharge area R2. Comparing to the face of a clock, in this embodiment, the processing area R1 before discharge is positioned at almost 10 o'clock, the discharge area R2 is in a range from almost 11 o'clock to 1 o'clock, the processing area R3 after discharge is positioned at almost 2 o'clock, and the processing area R4 after discharge is positioned at almost 4 o'clock. The transfer area R5 is positioned at almost 6 o'clock, and the processing area R6 after transfer is an area at almost 8 o'clock.

The transfer member 2 may be formed by a single layer but may be an accumulative body of a plurality of layers. If the transfer member 2 is formed by the plurality of layers, it may include three layers of, for example, a surface layer, an elastic layer, and a compressed layer. The surface layer is an outermost layer having an image formation surface where the ink image is formed. By providing the compressed layer, the compressed layer absorbs deformation and disperses a local pressure fluctuation, making it possible to maintain transferability even at the time of high-speed printing. The elastic layer is a layer between the surface layer and the compressed layer.

As a material for the surface layer, various materials, such as a resin and a ceramic can be used appropriately. With respect to durability, or the like, however, a material high in compressive modulus can be used. More specifically, an acrylic resin, an acrylic silicone resin, a fluoride-containing resin, a condensate obtained by condensing a hydrolyzable organosilicon compound, and the like, can be used. The surface layer that has undergone a surface treatment may be used in order to improve wettability of the reactive liquid, the transferability of an image, or the like. Frame processing, a corona treatment, a plasma treatment, a polishing treatment, a roughing treatment, an active energy beam irradiation treatment, an ozone treatment, a surfactant treatment, a silane coupling treatment, or the like, can be used as the surface treatment. A plurality of them may be combined. It is also possible to provide any desired surface shape in the surface layer.

For example, acrylonitrile-butadiene rubber, acrylic rubber, chloroprene rubber, urethane rubber, silicone rubber, or the like can be given as a material for the compressed layer. When such a rubber material is formed, a porous rubber material may be formed by blending a predetermined amount of a vulcanizing agent, vulcanizing accelerator, or the like and further blending a foaming agent, or a filling agent such as hollow fine particles or salt as needed. Consequently, a bubble portion is compressed along with a volume change with respect to various pressure fluctuations, and thus deformation in directions other than a compression direction is small, making it possible to obtain more stable transferability and durability. As the porous rubber material, there are a material having an open cell structure in which respective pores continue to each other and a material having a closed cell structure in which the respective pores are independent of each other. However, either structure may be used, or both of these structures may be used.

As a member for the elastic layer, the various materials, such as the resin and the ceramic, can be used appropriately. With respect to processing characteristics, various materials of an elastomer material and a rubber material can be used. More specifically, for example, fluorosilicone rubber, phenyl silicone rubber, fluorine rubber, chloroprene rubber, urethane rubber, nitrile rubber, and the like, can be used. In addition, ethylene propylene rubber, natural rubber, styrene rubber, isoprene rubber, butadiene rubber, the copolymer of ethylene/propylene/butadiene, nitrile-butadiene rubber, and the like, can be used. In particular, silicone rubber, fluorosilicone rubber, and phenyl silicon rubber are advantageous in terms of dimensional stability and durability because of their small compression set. They are also advantageous in terms of transferability because of their small elasticity change by a temperature.

Between the surface layer and the elastic layer and between the elastic layer and the compressed layer, various adhesives or double-sided adhesive tapes can also be used in order to fix them to each other. The transfer member 2 may also include a reinforce layer high in compressive modulus in order to suppress elongation in a horizontal direction or maintain resilience when attached to the transfer drum 41. Woven fabric may be used as a reinforce layer. The transfer member 2 can be manufactured by combining the respective layers formed by the materials described above in any desired manner.

The outer peripheral surface of the pressurizing drum 42 is pressed against the transfer member 2. At least one grip mechanism which grips the leading edge portion of the print medium P is provided on the outer peripheral surface of the pressurizing drum 42. A plurality of grip mechanisms may be provided separately in the circumferential direction of the pressurizing drum 42. The ink image on the transfer member 2 is transferred to the print medium P when it passes through a nip portion between the pressurizing drum 42 and the transfer member 2 while being conveyed in tight contact with the outer peripheral surface of the pressurizing drum 42.

The transfer drum 41 and the pressurizing drum 42 share a driving source such as a motor that drives them. A driving force can be delivered by a transmission mechanism such as a gear mechanism.

<Peripheral Unit>

The peripheral units 5A to 5E are arranged around the transfer drum 41. In this embodiment, the peripheral units 5A to 5E are specifically an application unit, an absorption unit, a heating unit, a cleaning unit, and a cooling unit in order.

The application unit 5A is a mechanism which applies the reactive liquid onto the transfer member 2 before the print unit 3 discharges ink. The reactive liquid is a liquid that contains a component increasing an ink viscosity. An increase in ink viscosity here means that a coloring material, a resin, and the like that form the ink react chemically or suck physically by contacting the component that increases the ink viscosity, recognizing the increase in ink viscosity. This increase in ink viscosity includes not only a case in which an increase in viscosity of entire ink is recognized but also a case in which a local increase in viscosity is generated by coagulating some of components such as the coloring material and the resin that form the ink.

The component that increases the ink viscosity can use, without particular limitation, a substance such as metal ions or a polymeric coagulant that causes a pH change in ink and coagulates the coloring material in the ink, and can use an organic acid. For example, a roller, a printhead, a die coating apparatus (die coater), a blade coating apparatus (blade coater), or the like can be given as a mechanism which applies the reactive liquid. If the reactive liquid is applied to the transfer member 2 before the ink is discharged to the transfer member 2, it is possible to immediately fix ink that reaches the transfer member 2. This makes it possible to suppress bleeding caused by mixing adjacent inks.

The absorption unit 5B is a mechanism which absorbs a liquid component from the ink image on the transfer member 2 before transfer. It is possible to suppress, for example, a blur of an image printed on the print medium P by decreasing the liquid component of the ink image. Describing a decrease in liquid component from another point of view, it is also possible to represent it as condensing ink that forms the ink image on the transfer member 2. Condensing the ink means increasing the content of a solid content such as a coloring material or a resin included in the ink with respect to the liquid component by decreasing the liquid component included in the ink.

The absorption unit 5B includes, for example, a liquid absorbing member that decreases the amount of the liquid component of the ink image by contacting the ink image. The liquid absorbing member may be formed on the outer peripheral surface of the roller or may be formed into an endless sheet-like shape and run cyclically. In terms of protection of the ink image, the liquid absorbing member may be moved in synchronism with the transfer member 2 by making the moving speed of the liquid absorbing member equal to the peripheral speed of the transfer member 2.

The liquid absorbing member may include a porous body that contacts the ink image. The pore size of the porous body on the surface that contacts the ink image may be equal to or smaller than 10 μm in order to suppress adherence of an ink solid content to the liquid absorbing member. The pore size here refers to an average diameter and can be measured by a known means such as a mercury intrusion technique, a nitrogen adsorption method, an SEM image observation, or the like. Note that the liquid component does not have a fixed shape, and is not particularly limited if it has fluidity and an almost constant volume. For example, water, an organic solvent, or the like contained in the ink or reactive liquid can be given as the liquid component.

The heating unit 5C is a mechanism which heats the ink image on the transfer member 2 before transfer. A resin in the ink image melts by heating the ink image, improving transferability to the print medium P. A heating temperature can be equal to or higher than the minimum film forming temperature (MFT) of the resin. The MFT can be measured by each apparatus that complies with a generally known method such as JIS K 6828-2: 2003 or ISO 2115: 1996. From the viewpoint of transferability and image robustness, the ink image may be heated at a temperature higher than the MFT by 10° C. or higher, or may further be heated at a temperature higher than the MFT by 20° C. or higher. The heating unit 5C can use a known heating device, for example, various lamps such as infrared rays, a warm air fan, or the like. An infrared heater can be used in terms of heating efficiency.

The cleaning unit 5D is a mechanism which cleans the transfer member 2 after transfer. The cleaning unit 5D removes ink remaining on the transfer member 2, dust on the transfer member 2, or the like. The cleaning unit 5D can use a known method, for example, a method of bringing a porous member into contact with the transfer member 2, a method of scraping the surface of the transfer member 2 with a brush, a method of scratching the surface of the transfer member 2 with a blade, or the like as needed. A known shape such as a roller shape or a web shape can be used for a cleaning member used for cleaning.

The cooling unit 5E is a cooling mechanism which applies a cooling liquid to the transfer member 2 which has been cleaned by the cleaning unit 5D, and collects the cooling liquid. A detail arrangement of application and collection of a cooling liquid will be described later. Note that the cooling is controlled based on temperatures detected by a plurality of temperature sensors provided around the transfer member 2, and consequently the cooling effect is controlled. The cooling unit 5E further includes an air blowing mechanism which blows air to the surface of the transfer member 2. This air blowing mechanism is desirably a blower or air-knife, for example.

As described above, in this embodiment, the application unit 5A, the absorption unit 5B, the heating unit 5C, the cleaning unit 5D, and the cooling unit 5E are included as the peripheral units. However, the present invention is not limited to separate units as shown in FIG. 1. For example, a cooling function equivalent to that of the cooling unit 5E of the transfer member 2 may be added to the application unit 5A or the cleaning unit 5D. Note that a cooling timing may be a period before application of the reactive liquid after transfer and cleaning.

<Supply Unit>

The supply unit 6 is a mechanism which supplies ink to each printhead 30 of the print unit 3. The supply unit 6 may be provided on the rear side of the printing system 1. The supply unit 6 includes a reservoir TK that reserves ink for each kind of ink. Each reservoir TK may be made of a main tank and a sub tank. Each reservoir TK and a corresponding one of the printheads 30 communicate with each other by a liquid passageway 6*a*, and ink is supplied from the reservoir TK to the printhead 30. The liquid passageway 6*a* may circulate ink between the reservoirs TK and the printheads 30. The supply unit 6 may include, for example, a pump that circulates ink. A deaerating mechanism which deaerates bubbles in ink may be provided in the middle of the liquid passageway 6*a* or in each reservoir TK. A valve that adjusts the fluid pressure of ink and an atmospheric pressure may be provided in the middle of the liquid passageway 6*a* or in each reservoir TK. The heights of each reservoir TK and each printhead 30 in the Z direction may be designed such that the liquid surface of ink in the reservoir TK is positioned lower than the ink discharge surface of the printhead 30.

<Conveyance Apparatus>

The conveyance apparatus 1B is an apparatus that feeds the print medium P to the transfer unit 4 and discharges, from the transfer unit 4, the printed product P' to which the ink image was transferred. The conveyance apparatus 1B includes a feeding unit 7, a plurality of conveyance drums 8 and 8*a*, two sprockets 8*b*, a chain 8*c*, and a collection unit 8*d*. In FIG. 1, an arrow inside a view of each constituent element in the conveyance apparatus 1B indicates a rotation direction of the constituent element, and an arrow outside the view of each constituent element indicates a conveyance path of the print medium P or the printed product P'. The print medium P is conveyed from the feeding unit 7 to the transfer unit 4, and the printed product P' is conveyed from the transfer unit 4 to the collection unit 8*d*. The side of the feeding unit 7 may be referred to as an upstream side in a conveyance direction, and the side of the collection unit 8*d* may be referred to as a downstream side.

The feeding unit 7 includes a stacking unit where the plurality of print media P are stacked and a feeding mechanism which feeds the print media P one by one from the stacking unit to the most upstream conveyance drum 8. Each of the conveyance drums 8 and 8*a* is a rotating body that rotates about the rotation axis in the Y direction and has a columnar outer peripheral surface. At least one grip mechanism which grips the leading edge portion of the print medium P (printed product P') is provided on the outer peripheral surface of each of the conveyance drums 8 and 8*a*. A gripping operation and release operation of each grip mechanism may be controlled such that the print medium P is transferred between the adjacent conveyance drums.

The two conveyance drums 8*a* are used to reverse the print medium P. When the print medium P undergoes double-side printing, it is not transferred to the conveyance drum 8 adjacent on the downstream side, but is transferred to the conveyance drums 8*a* from the pressurizing drum 42 after transfer onto the surface. The print medium P is reversed via the two conveyance drums 8*a* and is transferred to the pressurizing drum 42 again via the conveyance drums 8 on the upstream side of the pressurizing drum 42. Consequently, the reverse surface of the print medium P faces the transfer drum 41, transferring the ink image to the reverse surface.

The chain 8*c* is wound between the two sprockets 8*b*. One of the two sprockets 8*b* is a driving sprocket, and the other is a driven sprocket. The chain 8*c* runs cyclically by rotating the driving sprocket. The chain 8*c* includes a plurality of grip mechanisms spaced apart from each other in its longitudinal direction. Each grip mechanism grips the end of the printed product P'. The printed product P' is transferred from the conveyance drum 8 positioned at a downstream end to each grip mechanism of the chain 8*c*, and the printed product P' gripped by the grip mechanism is conveyed to the collection unit 8*d* by running the chain 8*c*, releasing gripping. Consequently, the printed product P' is stacked in the collection unit 8*d*.

<Post Processing Unit>

The conveyance apparatus 1B includes post processing units 10A and 10B. The post processing units 10A and 10B are mechanisms which are arranged on the downstream side of the transfer unit 4, and perform post processing on the printed product P'. The post processing unit 10A performs processing on the obverse surface of the printed product P', and the post processing unit 10B performs processing on the reverse surface of the printed product P'. The contents of the post processing includes, for example, coating that aims at protection, improving glossiness, and the like, of an image on the image printed surface of the printed product P'. For example, liquid application, sheet welding, lamination, and the like, can be used as an example of coating.

<Inspection Unit>

The conveyance apparatus 1B includes inspection units 9A and 9B. The inspection units 9A and 9B are mechanisms which are arranged on the downstream side of the transfer unit 4, and inspect the printed product P'.

In this embodiment, the inspection unit 9A is an image capturing apparatus that captures an image printed on the printed product P' and includes an image sensor, for example, a CCD sensor, a CMOS sensor, or the like. The inspection unit 9A captures a printed image while a printing operation is performed continuously. Based on the image captured by the inspection unit 9A, it is possible to confirm a temporal change in tint, or the like, of the printed image and determine whether to correct image data or print data. In this embodiment, the inspection unit 9A has an imaging range set on the outer peripheral surface of the pressurizing drum 42 and is arranged to be able to partially capture the printed image immediately after transfer. The inspection unit 9A may inspect all printed images or may inspect the images every predetermined number of sheets.

In this embodiment, the inspection unit 9B is also an image capturing apparatus that captures an image printed on the printed product P' and includes an image sensor, for example, a CCD sensor, a CMOS sensor, or the like. The inspection unit 9B captures a printed image in a test printing operation. The inspection unit 9B can capture the entire printed image. Based on the image captured by the inspection unit 9B, it is possible to perform basic settings for various correction operations regarding print data. In this embodiment, the inspection unit 9B is arranged at a position to capture the printed product P' conveyed by the chain 8*c*. When the inspection unit 9B captures the printed image, it captures the entire image by temporarily suspending the run of the chain 8*c*. The inspection unit 9B may be a scanner that scans the printed product P'.

<Control Unit>

Figure 4:
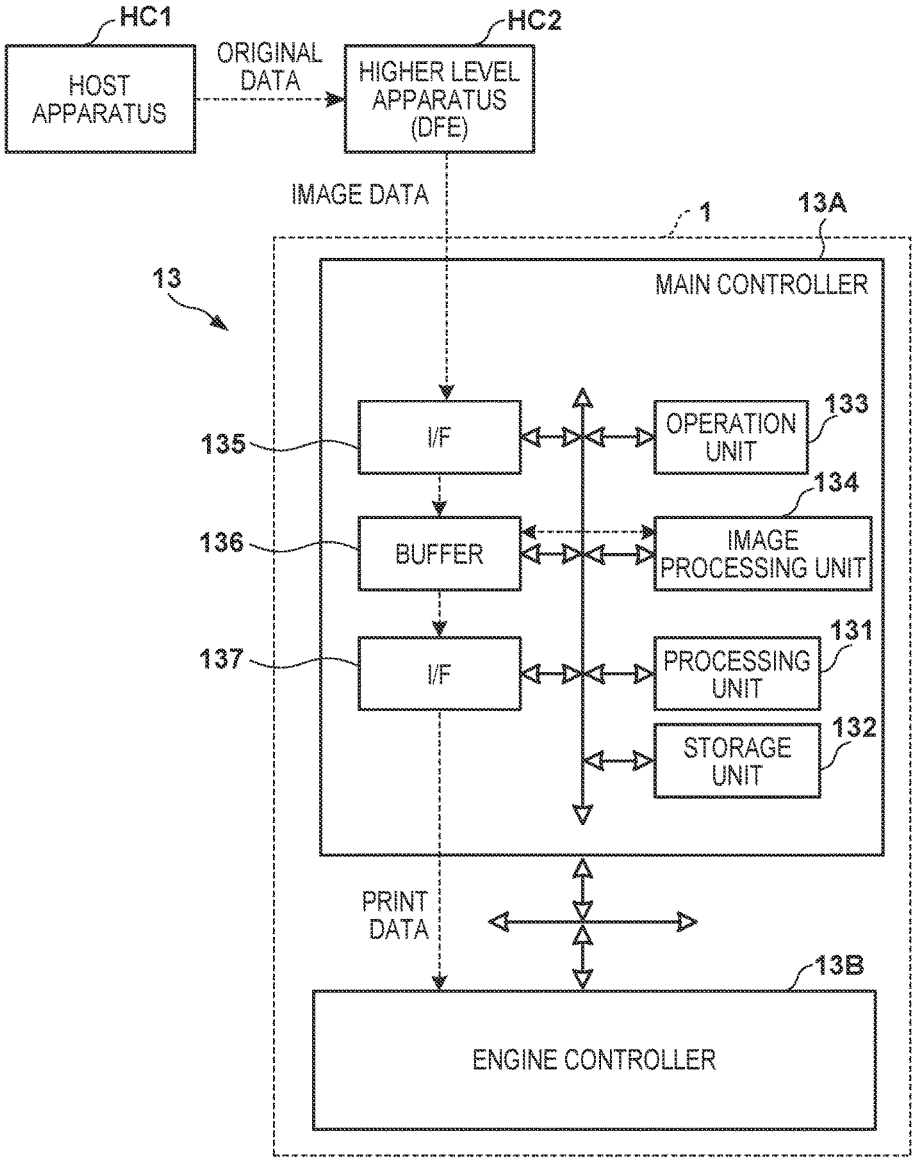
FIG. 4 is a block diagram showing a control system of the printing system in FIG. 1.
Figure 5:
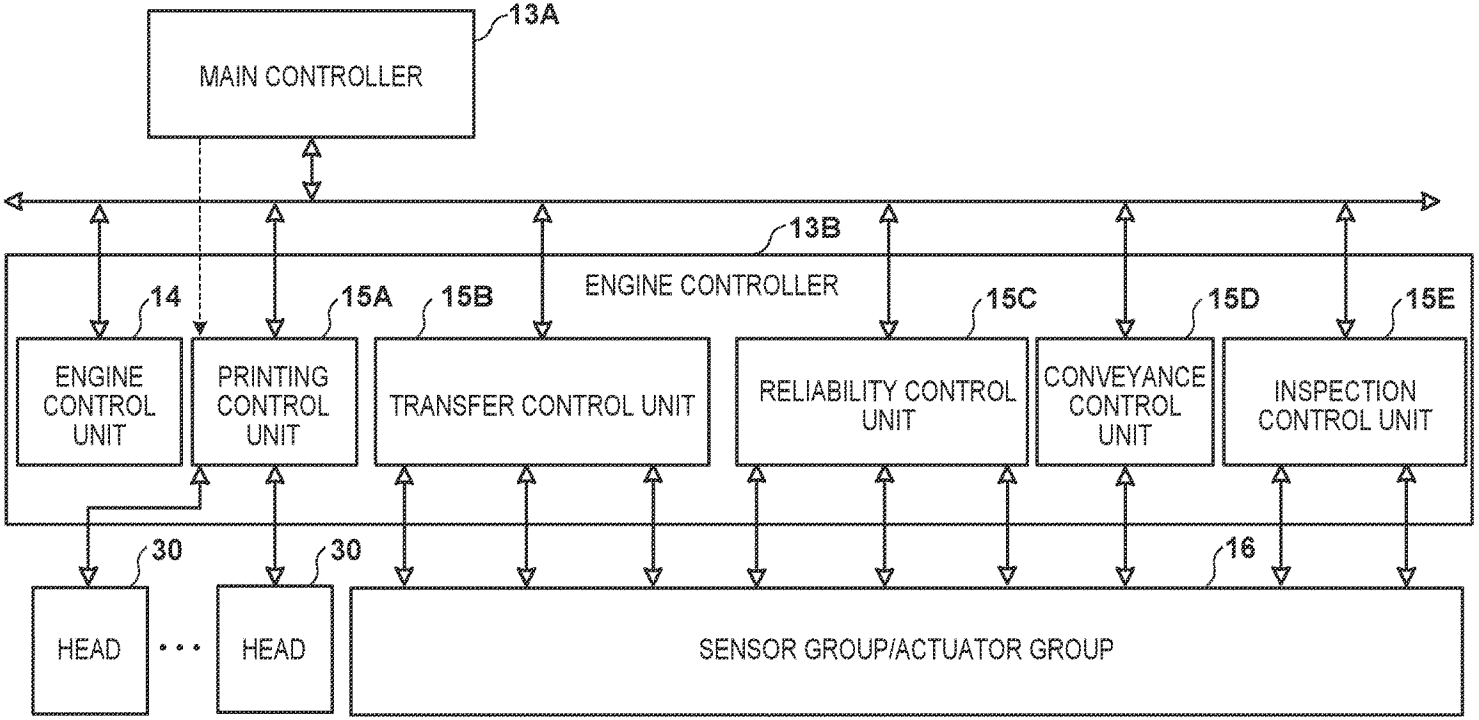
FIG. 5 is a block diagram showing the control system of the printing system in FIG. 1.

A control unit of the printing system 1 will be described next. FIGS. 4 and 5 are block diagrams each showing a control unit 13 of the printing system 1. The control unit 13 is communicably connected to a higher level apparatus (DFE) HC2, and the higher level apparatus HC2 is communicably connected to a host apparatus HC1.

The host apparatus HC1 may be, for example, a PC (Personal Computer) serving as an information processing apparatus, or a server apparatus. A communication method between the host apparatus HC1 and the higher level apparatus HC2 may be, without particular limitation, either wired or wireless communication.

Original data to be the source of a printed image is generated or saved in the host apparatus HC1. The original data here is generated in the format of, for example, an electronic file such as a document file or an image file. This original data is transmitted to the higher level apparatus HC2. In the higher level apparatus HC2, the received original data is converted into a data format (for example, RGB data that represents an image by RGB) available by the control unit 13. The converted data is transmitted from the higher level apparatus HC2 to the control unit 13 as image data. The control unit 13 starts a printing operation based on the received image data.

In this embodiment, the control unit 13 is roughly divided into a main controller 13A and an engine controller 13B. The main controller 13A includes a processing unit 131, a storage unit 132, an operation unit 133, an image processing unit 134, a communication I/F (interface) 135, a buffer 136, and a communication I/F 137.

The processing unit 131 is a processor such as a CPU, executes programs stored in the storage unit 132, and controls the entire main controller 13A. The storage unit 132 is a storage device such as a RAM, a ROM, a hard disk, or an SSD, stores data and the programs executed by the processing unit (CPU) 131, and provides the processing unit (CPU) 131 with a work area. An external storage unit may further be provided in addition to the storage unit 132. The operation unit 133 is, for example, an input device such as a touch panel, a keyboard, or a mouse and accepts a user instruction. The operation unit 133 may be formed by an input unit and a display unit integrated with each other. Note that a user operation is not limited to an input via the operation unit 133, and an arrangement may be possible in which, for example, an instruction is accepted from the host apparatus HC1 or the higher level apparatus HC2.

The image processing unit 134 is, for example, an electronic circuit including an image processing processor. The buffer 136 is, for example, a RAM, a hard disk, or an SSD. The communication I/F 135 communicates with the higher level apparatus HC2, and the communication I/F 137 communicates with the engine controller 13B. In FIG. 4, broken-line arrows exemplify the processing sequence of image data. Image data received from the higher level apparatus HC2 via the communication I/F 135 is accumulated in the buffer 136. The image processing unit 134 reads out the image data from the buffer 136, performs predetermined image processing on the readout image data, and stores the processed data in the buffer 136 again. The image data after the image processing stored in the buffer 136 is transmitted from the communication I/F 137 to the engine controller 13B as print data used by a print engine.

As shown in FIG. 5, the engine controller 13B includes engine control units 14 and 15A to 15E, and obtains a detection result of a sensor group/actuator group 16 of the printing system 1 and controls driving of the groups. Each of these control units includes a processor, such as a CPU, a storage device, such as a RAM or a ROM, and an interface with an external device. Note that the division of the control units is merely illustrative, and a plurality of subdivided control units may perform some of control operations or conversely, the plurality of control units may be integrated with each other, and one control unit may be configured to implement their control contents.

The engine control unit 14 controls the entire engine controller 13B. The printing control unit 15A converts print data received from the main controller 13A into raster data or the like in a data format suitable for driving of the printheads 30. The printing control unit 15A controls discharge of each printhead 30.

The transfer control unit 15B controls the application unit 5A, the absorption unit 5B, the heating unit 5C, and the cleaning unit 5D.

The reliability control unit 15C controls the supply unit 6, the recovery unit 12, and a driving mechanism which moves the print unit 3 between the discharge position POS1 and the recovery position POS3.

The conveyance control unit 15D controls driving of the transfer unit 4 and controls the conveyance apparatus 1B. The inspection control unit 15E controls the inspection unit 9B and the inspection unit 9A.

Of the sensor group/actuator group 16, the sensor group includes a sensor that detects the position and speed of a movable part, a sensor that detects a temperature, an image sensor, and the like. The actuator group includes a motor, an electromagnetic solenoid, an electromagnetic valve, and the like.

<Operation Example>

Figure 6:
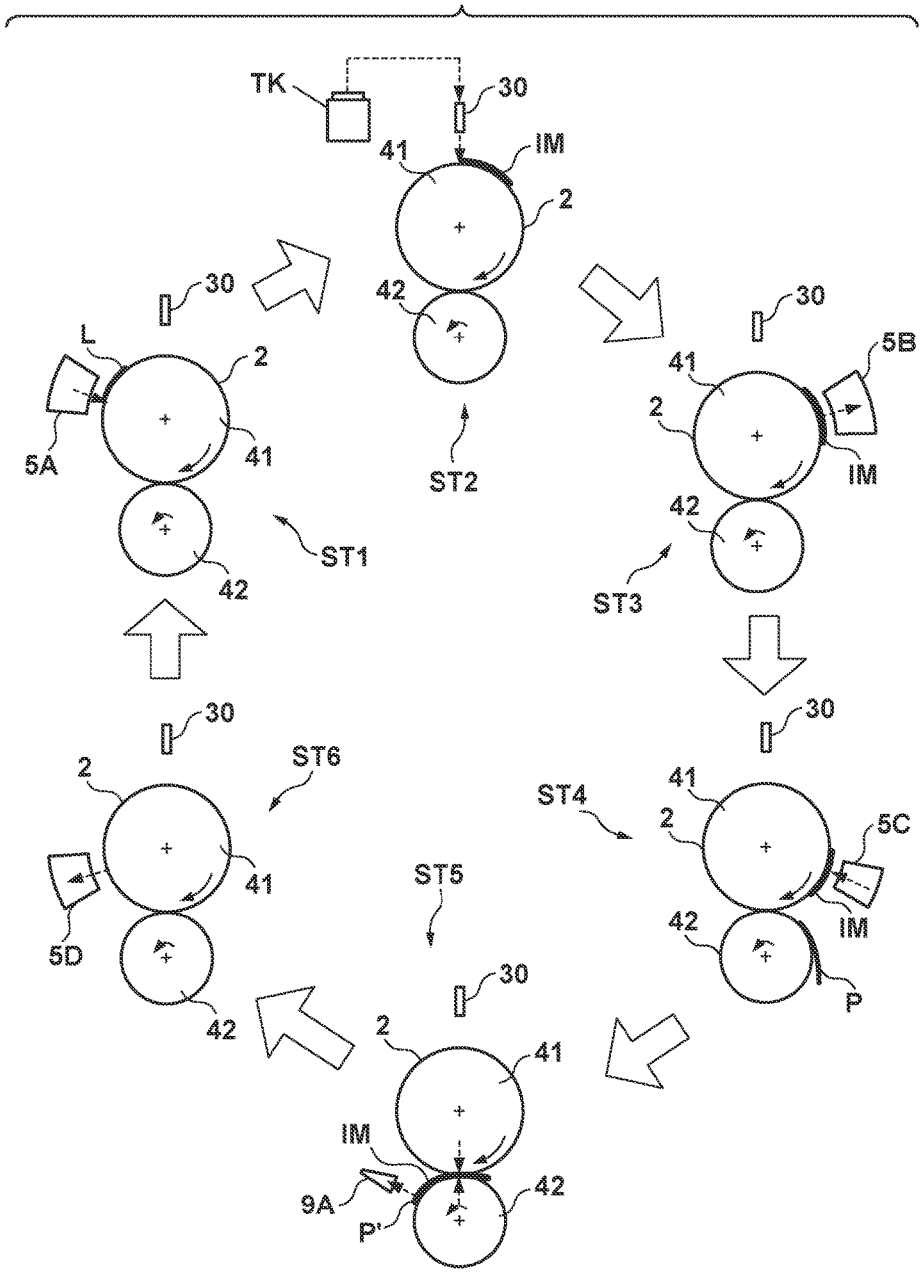
FIG. 6 is an explanatory view showing an example of the operation of the printing system in FIG. 1.

FIG. 6 is a view schematically showing an example of a printing operation. Respective steps below are performed cyclically while rotating the transfer drum 41 and the pressurizing drum 42. As shown in a state ST1, first, a reactive liquid L is applied from the application unit 5A onto the transfer member 2. A portion to which the reactive liquid L on the transfer member 2 is applied moves along with the rotation of the transfer drum 41. When the portion to which the reactive liquid L is applied reaches under the printhead 30, ink is discharged from the printhead 30 to the transfer member 2 as shown in a state ST2. Consequently, an ink image IM is formed. At this time, the discharged ink mixes with the reactive liquid L on the transfer member 2, promoting coagulation of the coloring materials. The discharged ink is supplied from the reservoir TK of the supply unit 6 to the printhead 30.

The ink image IM on the transfer member 2 moves along with the rotation of the transfer member 2. When the ink image IM reaches the absorption unit 5B, as shown in a state ST3, the absorption unit 5B absorbs a liquid component from the ink image IM. When the ink image IM reaches the heating unit 5C, as shown in a state ST4, the heating unit 5C heats the ink image IM, a resin in the ink image IM melts, and a film of the ink image IM is formed. In synchronism with such formation of the ink image IM, the conveyance apparatus 1B conveys the print medium P.

As shown in a state ST5, the ink image IM and the print medium P reach the nip portion between the transfer member 2 and the pressurizing drum 42, the ink image IM is transferred to the print medium P, and the printed product P' is formed. Passing through the nip portion, the inspection unit 9A captures an image printed on the printed product P' and inspects the printed image. The conveyance apparatus 1B conveys the printed product P' to the collection unit 8*d*.

When a portion where the ink image IM on the transfer member 2 is formed reaches the cleaning unit 5D, it is cleaned by the cleaning unit 5D as shown in a state ST6. After the cleaning, the transfer member 2 rotates once, and transfer of the ink image to the print medium P is performed repeatedly in the same procedure. The description above has been given such that transfer of the ink image IM to one print medium P is performed once in one rotation of the transfer member 2 for the sake of easy understanding. It is possible, however, to continuously perform transfer of the ink image IM to the plurality of print media P in one rotation of the transfer member 2.

Each printhead 30 needs maintenance if such a printing operation continues.

Figure 7:
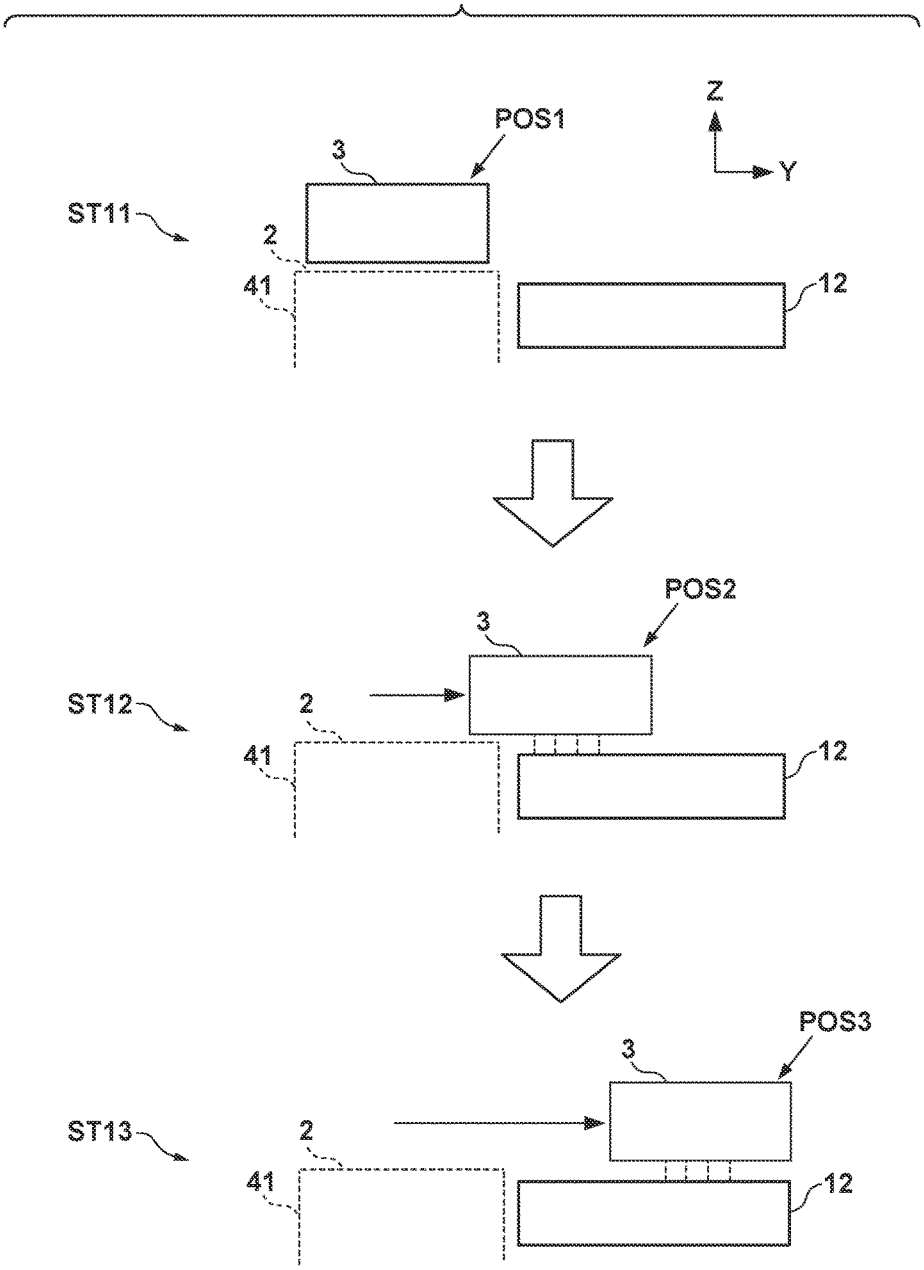
FIG. 7 is an explanatory view showing an example of the operation of the printing system in FIG. 1.

FIG. 7 shows an operation example at the time of maintenance of each printhead 30. A state ST11 shows a state in which the print unit 3 is positioned at the discharge position POS1. A state ST12 shows a state in which the print unit 3 passes through the preliminary recovery position POS2. Under passage, the recovery unit 12 performs a process of recovering discharge performance of each printhead 30 of the print unit 3. Subsequently, as shown in a state ST13, the recovery unit 12 performs the process of recovering the discharge performance of each printhead 30 in a state in which the print unit 3 is positioned at the recovery position POS3.

Control of effectively cooling the transfer member 2 and properly maintaining the temperature of the transfer member 2 while cleaning the surface of the transfer member 2 after an image is transferred in the printing system having the above arrangement will be described next.

<Temperature Control of Transfer Member>

Figure 8:
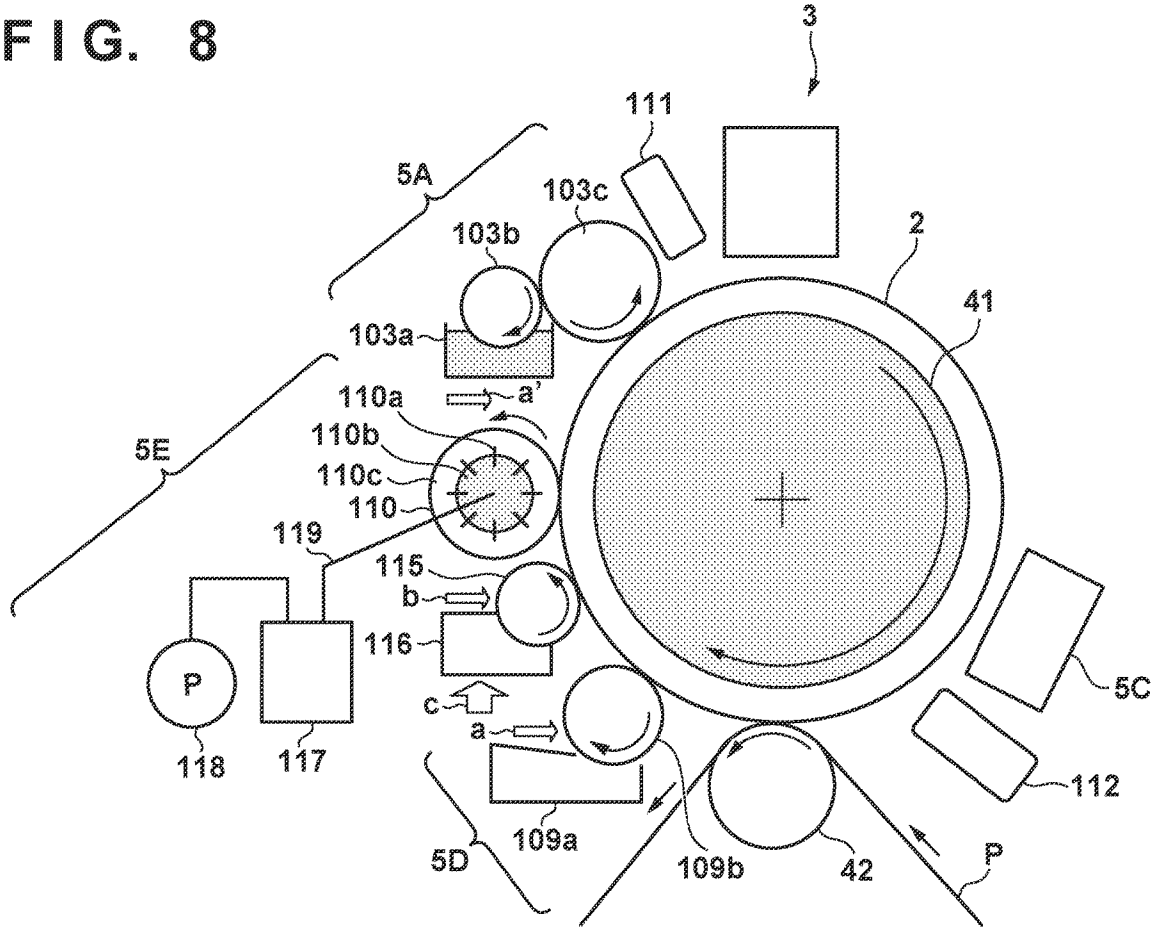
FIG. 8 is a view schematically showing constituent elements provided around the transfer member in order to perform cleaning and temperature control of the transfer member.

FIG. 8 is a view schematically showing constituent elements provided around the transfer member in order to perform temperature control of the transfer member. Note that in FIG. 8, out of the various constituent elements of the printing system shown in FIG. 1, portions that are not directly related to the temperature control of the transfer member are not illustrated. Also in FIG. 8, the same reference numerals denote the constituent elements that have already been described with reference to FIG. 1, and a description thereof will not be repeated.

As shown in FIG. 8, with respect to a rotation direction of the transfer member 2, a first temperature sensor 111 is provided on the downstream side of the application unit 5A, and a second temperature sensor 112 is provided on the downstream side of the heating unit 5C. By thus arranging the two temperature sensors, the first temperature sensor 111 detects the temperature of the transfer member 2 cooled by the cleaning unit 5D and the cooling unit 5E, and the second temperature sensor 112 detects the temperature of the transfer member 2 heated by the heating unit 5C. Each of the temperature sensors 111 and 112 is a non-contact sensor that detects the temperature of the transfer member 2 by detecting infrared rays radiated from the surface of the transfer member 2.

With such an arrangement, the temperature of the transfer member 2 is held between $T_1$° C. and $T_2$° C. immediately below the print unit 3. On the other hand, the temperature is held between $T_3$° C. and $T_4$° C. in the nip portion between the transfer drum 41 to which an image is transferred and the pressurizing drum 42.

The application unit 5A includes a reactive liquid container 103*a* that contains the reactive liquid L applied to the transfer member 2, a roller 103*b* that extracts the reactive liquid L contained in the reactive liquid container 103*a*, and a roller 103*c* that applies the reactive liquid L impregnated in the roller 103*b* to the transfer member 2. The application unit 5A has a circulation arrangement of the reactive liquid and a cooling arrangement that cools the reactive liquid, and can contribute to cooling control of the transfer member 2.

The cleaning unit 5D includes a CL liquid container 109*a* that contains a CL liquid used to clean the transfer member 2 and a cleaning roller (first supplying roller) 109*b* that applies the CL liquid contained there to the transfer member 2. When performing a cleaning operation, the cleaning roller 109*b* moves in a direction of an arrow a and rotates in contact with the transfer member 2. The cleaning unit 5D has a circulation arrangement of the CL liquid, a cooling function of cooling the CL liquid, a function of adjusting the application amount of the CL liquid, and a function of adjusting a contact pressure of the cleaning roller 109*b*, and can contribute to the cooling control of the transfer member 2.

Note that a rotation direction of the cleaning roller 109*b* is the same as a rotation direction (clockwise) of the transfer member 2, and they move in directions opposite each other in a contact portion, making a relative velocity difference bigger. More specifically, the transfer member 2 rotates clockwise at the peripheral velocity of 600 mm/sec, and the cleaning roller 109*b* rotates clockwise at the peripheral velocity of 133 mm/sec. That is, in a contact portion between the transfer member 2 and the cleaning roller 109*b*, a moving direction on the surface of the cleaning roller 109*b* is set in a direction opposite to a moving direction on the surface of the transfer member 2. Consequently, a cleaning effect is enhanced, and an object to be cleaned hardly remains in a nip portion between the cleaning roller 109*b* and the transfer member 2. Note that the above-described effect is obtained if there is the relative velocity difference between the cleaning roller 109*b* and the transfer member 2 in the contact portion, and thus a mode may be adopted in which they have the same moving direction at the contact portion and different velocities.

An apparatus of this embodiment includes a cooling unit (second liquid application unit) 5E between the application unit (first liquid application unit) 5A and the cleaning unit 5D, as shown in FIG. 8.

The cooling unit 5E includes a cooling roller (second supplying roller) 115 that applies a coolant to the transfer member 2, a reservoir 116 that reserves the coolant, a collection roller 110 that collects the coolant applied to the transfer member 2, a gas-liquid separation tank (collection tank) 117, and a vacuum pump (P) 118. Note that although not illustrated, an air blowing mechanism that blows air to the transfer member 2 after a liquid is collected from the transfer member 2 to speed up cooling is further provided as a part of the cooling unit 5E.

The reservoir 116 includes a circulation mechanism of the coolant and a cooling mechanism of the coolant, and reserves a coolant managed at an appropriate temperature. The coolant is drawn up from the reservoir 116 by rotating the cooling roller 115, and the coolant is applied to the transfer member 2 by bringing the cooling roller 115 into contact with the transfer member 2. When a portion of the transfer member 2 cleaned by the cleaning unit 5D reaches a position at which the cooling roller 115 is provided by the rotation, the cooling roller 115 applies the coolant to further cool the portion. Then, when the portion of the transfer member 2 to which the coolant is applied reaches a position at which the collection roller 110 is provided, the collection roller 110 contacts the transfer member 2, collecting the coolant. When the transfer member 2 further rotates and reaches an air blowing position of the air blowing mechanism, the surface of the transfer member is further cooled by blowing air, and evaporation of a remaining liquid is sped up.

Figure 9A:
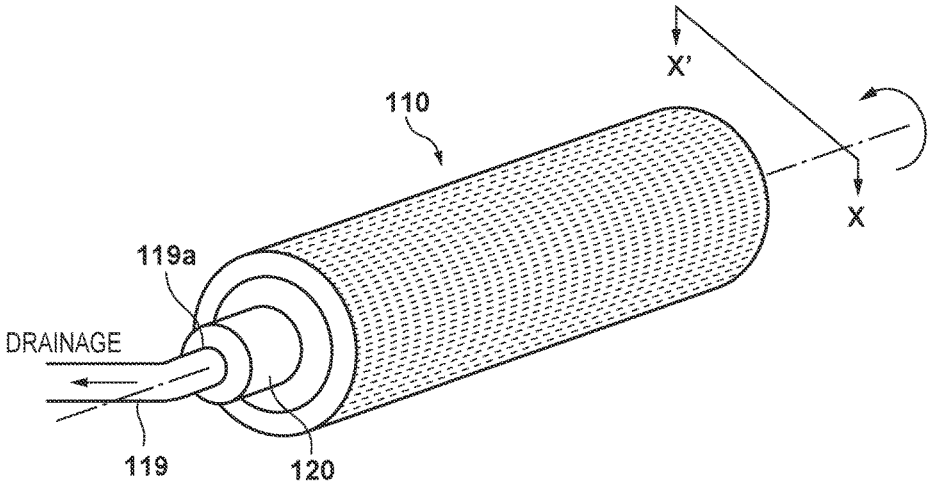
FIGS. 9A and 9B are views each showing the detailed structure of the collection roller 110.
Figure 9B:
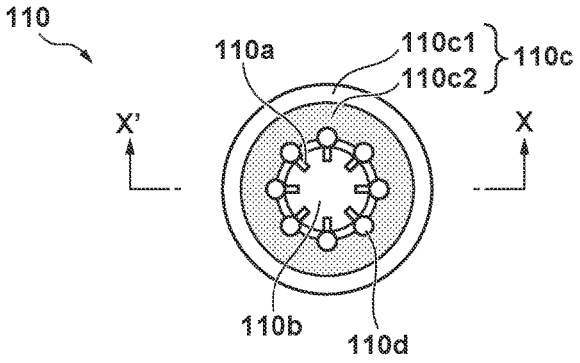

FIGS. 9A and 9B are views each showing the arrangement of the collection roller 110. FIG. 9A is a perspective view showing the outer appearance of the roller. FIG. 9B is a sectional view showing the roller along with a line X-X' in FIG. 9A. A center 110*b* of the collection roller 110 forms a cavity, and a plurality of gas-liquid channels 110*a* are provided around the cavity. An outer peripheral portion 110*c* of the collection roller 110 is formed by a flexible porous member (porous body). Therefore, if the collection roller 110 is brought into contact with the transfer member 2 and rotates in a direction opposite to a rotation direction of the transfer member 2, a liquid applied to the transfer member 2 is absorbed via many holes of the outer peripheral portion 110*c*, and the liquid is directed to the cavity of the center 110*b*. The center 110*b* of the collection roller 110 is connected to a tube 119 coaxially led to a roller rotation axis.

Referring back to FIG. 8, the tube 119 led from the collection roller 110 is connected to the gas-liquid separation tank 117, and the gas-liquid separation tank 117 is connected to the vacuum pump 118. Therefore, if the vacuum pump 118 is driven to generate a negative pressure inside the gas-liquid separation tank 117, a coolant reaching the cavity of the center 110*b* is sucked out to the gas-liquid separation tank 117 due to the negative pressure.

Note that if a collected liquid has a reusable property, it becomes possible to reuse a coolant by filtering an impurity or foreign substance with a filter or the like from a liquid collected to the gas-liquid separation tank 117, and then returning the liquid to the reservoir 116.

The reservoir 116 moves in a direction of an arrow c to contact a part of the cooling roller 115, allowing the cooling roller 115 to draw up the coolant reserved in the reservoir 116. After the cooling roller 115 draws up the reserved liquid, a squeezing roller (not shown) can meter the drawn-up liquid. Alternatively, the reservoir 116 can move in a direction opposite to the direction of the arrow c and separate from the cooling roller 115. Thus, the amount of the coolant contained by the cooling roller 115 is changed due to a time of contact with the squeezing roller or contact/separation of the reservoir 116 and cooling roller 115. As a result, it becomes possible to change an application amount of the coolant to the transfer member 2.

When performing a cooling operation, the cooling roller 115 moves in a direction of an arrow b and contacts the transfer member 2. In this case, a collection operation is also performed in synchronism with the cooling operation, and thus the collection roller 110 moves in the direction of the arrow a' and contacts the transfer member 2. A pressure when the cooling roller 115 contacts the transfer member 2 can be controlled by its contact mechanism (not shown). Therefore, it is also possible to control the application amount of the coolant to the transfer member 2 and a contact time by regulating the contact pressure.

In contrast to this, for example, when the cooling operation is not performed due to apparatus maintenance or the like and the temperature of the transfer member, the cooling roller 115 moves in a direction opposite to the arrow b and separates from the transfer member 2. In this case, the collection operation is performed in synchronism with the cooling operation, and thus the collection roller 110 also moves in a direction opposite to the arrow a' and separates from the transfer member 2.

When performing the cooling operation, the cooling roller 115 contacts the transfer member 2 after the collection roller 110 contacts the transfer member 2. When stopping the cooling operation, the collection roller 110 separates from the transfer member 2 after the cooling roller 115 separates from the transfer member 2. This makes it possible to collect a liquid from the transfer member 2 reliably.

As described above, the cleaning roller 109*b*, the cooling roller 115, and the collection roller 110 can contact/separate from the transfer member 2. Then, an arrangement capable of controlling the temperature of the coolant by the cooling mechanism, further controlling an air volume of the air blowing mechanism, and still further changing the application amount of the coolant to the transfer member 2 is adopted. Based on temperatures detected by the two temperature sensors 111 and 112, a cooling capability of the cooling unit 5E is adjusted by controlling the temperature of the coolant reserved in the reservoir 116, the amount of the coolant drawn up from the reservoir 116, the contact pressure of the cooling roller 115, and the air volume of the air blowing mechanism. This adjustment can be implemented by adjusting at least one of these.

Note that the temperature control of the transfer member 2 can also be performed by a unit different from the cooling unit 5E. It is also possible to adjust cooling of the transfer member 2 by, for example, adjusting a contact distance/contact pressure/relative velocity difference between the cleaning roller 109*b* and the transfer member 2, a liquid temperature in the CL liquid container 109*a*, the amount of a liquid drawn up from the CL liquid container 109*a*, the temperature of the reactive liquid of the application unit 5A, or the like. The temperature control of the transfer member 2 may be performed by adjusting one or a plurality of these items. The temperature control of the transfer member 2 is thus performed properly.

Cooling of the transfer member 2 is not limited to liquid application by the cooling roller 115. The CL liquid is applied to the surface of the transfer member when the cleaning unit 5D performs cleaning, and the transfer member 2 is also cooled by this liquid application. That is, the cleaning unit 5D has not only a cleaning function but also a cooling function. Therefore, if a proper temperature of the transfer member 2 is obtained by cooling with the cleaning roller 109*b*, it is also possible to omit the cooling roller 115. In this case, the collection roller 110 collects the remaining CL liquid applied to the transfer member 2 by the cleaning roller 109*b*. When starting the cooling operation with this arrangement, the cleaning roller 109*b* contacts the transfer member 2 after the collection roller 110 contacts the transfer member 2. On the other hand, when stopping the cooling operation, the collection roller 110 separates from the transfer member 2 after the cleaning roller 109*b* separates from the transfer member 2. This makes it possible to collect the CL liquid as the coolant from the transfer member 2 reliably.

The detailed structure of the collection roller 110 will be described here again with reference to FIGS. 9A and 9B. As shown in the perspective view of FIG. 9A, a connection port 120 is provided in a portion of the roller rotation axis at one end of the collection roller 110, and the tube 119 is connected to the connection port 120. A collection liquid accumulated in the cavity of the center 110*b* of the collection roller 110 is discharged outside the roller via the connection port 120 and the tube 119.

As shown in the sectional view of FIG. 9B, the outer peripheral portion 110*c* (absorber layer) is made up of an absorption layer 110*c*1 formed at an outermost position by a sheet-like and high-density porous material, and an absorption layer 110*c*2 formed inside thereof by a sheet-like and crude-density porous material. Notches 110*d* are formed in a plurality of portions of the absorption layer 110*c*2, and some of them are connected to the gas-liquid channels 110*a*. With this structure, a liquid absorbed to the absorption layer 110*c*1 reaches the absorption layer 110*c*2 by a capillary force and further reaches the cavity of the center 110*b* via the gas-liquid channels 110*a*. The liquid gathered in the cavity of the center 110*b* is discharged outside from an opening portion 119*a* communicating with the cavity.

According to the above-described embodiment, liquid application and liquid collection are performed before a next image is formed by the printheads 30 in a region on the transfer member after an ink image is transferred to a print medium. This makes it possible to effectively cool the transfer member 2 to maintain it at a predetermined temperature, effectively clean the transfer member 2, and keep the temperature and surface state of the transfer member 2 satisfactorily. This results in maintaining a satisfactory state for next image formation, making it possible to perform high-quality image formation continuously.

In liquid collection, the collection roller 110 rotates in contact with the transfer member 2, and thus both the collection roller 110 and the transfer member 2 have slow progress in member wear and improved durability, and apparatus performance is maintained even in a long-term apparatus operation. Accordingly, the effect of decreasing the frequency of apparatus maintenance is also obtained. Note that the collection roller 110 is structured to include the absorption layers on its surface and collect a liquid from the inside of the absorption layers, making it possible to collect the large amount of the liquid per unit time. This contributes to a throughput improvement of the entire apparatus and implements a printing apparatus capable of high-speed continuous printing.

Further, along the moving direction on the surface of the transfer member 2, the rollers, namely, the cleaning roller

109*b* (first supplying roller), the cooling roller 115 (second supplying roller), and the collection roller 110 are arranged in this order. The coolant is applied after cleaning is performed first to clean the surface of the transfer member, reducing a blot attached to the collection roller 110 and further enhancing the effect of decreasing the frequency of apparatus maintenance. Furthermore, because the cleaning roller 109*b* contacts the transfer member 2 before the cooling roller 115, cleaning is performed in a state in which the surface temperature of the transfer member 2 is higher, enhancing the cleaning effect.

While the rotation direction of the cleaning roller 109*b* is the same (clockwise) as the rotation direction of the transfer member 2, the rotation directions of the cooling roller 115 and collection roller 110 are opposite (counter-clockwise) to the rotation direction of the transfer member 2. That is, in the contact portion between the transfer member 2 and the cleaning roller 109*b*, the moving direction of the cleaning roller 109*b* is set in a direction opposite to the moving direction of the transfer member 2, making the relative velocity difference bigger. On the other hand, in a contact portion between the transfer member 2 and the cooling roller 115, the moving direction of the cooling roller 115 is set in the same direction as the moving direction of the transfer member 2, making a relative velocity difference smaller. More specifically, the transfer member 2 rotates clockwise at the peripheral velocity of 600 mm/sec, and the cooling roller 115 rotates counter-clockwise at the peripheral velocity of 600 mm/sec. In a contact portion between the transfer member 2 and the collection roller 110, the moving direction of the collection roller 110 is set in the same direction as the moving direction of the transfer member 2, making a relative velocity difference smaller. More specifically, the transfer member 2 rotates clockwise at the peripheral velocity of 600 mm/sec, and the collection roller 110 rotates counter-clockwise at the peripheral velocity of 600 mm/sec. Consequently, in cleaning, a dust particle hardly remains in the nip portion between the cleaning roller 109*b* and the transfer member 2, improving the cleaning effect. On the other hand, in cooling, wear is reduced thanks to smooth liquid application and liquid collection, improving the life of the apparatus.

<Other embodiment>

In the above embodiment, the print unit 3 includes the plurality of printheads 30. However, a form may include only one printhead 30. The printhead 30 need not be a full-line head but may be of a serial type that forms an ink image by discharging ink from the printhead 30 while moving the printhead 30 in the Y direction.

A conveyance mechanism of the print medium P may adopt another method such as a method of clipping and conveying the print medium P by the pair of rollers. In the method of conveying the print medium P by the pair of rollers or the like, a roll sheet may be used as the print medium P, and a printed product P' may be formed by cutting the roll sheet after transfer.

In the above embodiment, the transfer member 2 is provided on the outer peripheral surface of the transfer drum 41. However, another method such as a method of forming a transfer member 2 into an endless swath and running it cyclically may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-136444, filed Jul. 12, 2017, which is hereby incorporated by reference herein in its entirety.

What is claimed is:

1. A printing apparatus comprising:

a transfer member that rotates and moves cyclically;

a printhead configured to form an image on the transfer member;

a transfer unit configured to transfer, to a print medium, the image formed on the transfer member;

an application unit, provided at a downstream side of an area, at which the transfer unit transfers the image to the print medium, in a rotation direction of the transfer member, the application unit being configured to apply a cleaning liquid to a region on the transfer member after the image is transferred to the print medium; and a collecting unit, provided between the printhead and the application unit, in the rotation direction of the transfer member, the collecting unit including a collection roller that rotates in contact with the transfer member, in a direction opposite to the rotation direction of the transfer member, for collecting the cleaning liquid applied to the transfer member by the application unit.

2. The printing apparatus according to claim 1, wherein the application unit includes:

a first roller that rotates in contact with the transfer member, which moves; and a member configured to apply the cleaning liquid to the first roller.

3. The printing apparatus according to claim 2, wherein the application unit further includes:

a second roller configured to apply a cooling liquid to the transfer member between the first roller and the collection roller; and a member configured to apply the cooling liquid to the second roller, and wherein the first roller is a roller configured to clean the transfer member, and the second roller is a roller configured to cool the transfer member.

4. The printing apparatus according to claim 3, wherein, at a contact portion between the transfer member and the first roller, the first roller rotates such that a moving direction of the first roller is set in a direction opposite to a moving direction of the transfer member, wherein, at a contact portion between the transfer member and the second roller, the second roller rotates such that a moving direction of the second roller is set in the same direction as the moving direction of the transfer member, and wherein, at a contact portion between the transfer member and the collection roller, the collection roller rotates such that a moving direction of the collection roller is set in the same direction as the moving direction of the transfer member.

5. The printing apparatus according to claim 1, wherein an absorber layer that rotates in contact with the transfer member and absorbs the cleaning liquid applied to the transfer member is provided on an outer peripheral portion of the collection roller, and the cleaning liquid absorbed to the absorber layer is collected from an inside of the collection roller.

6. The printing apparatus according to claim 5, wherein the collection roller has a cavity, inside the absorber layer, in which the cleaning liquid absorbed by the absorber layer is stored, and the cleaning liquid stored in the cavity is discharged outside in a direction parallel to a rotation axis of the collection roller.

7. The printing apparatus according to claim 6, wherein the absorber layer includes:

a first absorption layer that contacts the transfer member and that is formed of a porous material;

a second absorption layer arranged inside the first absorption layer, and that is formed of a porous material having a lower density than that of the first absorption layer; and a gas-liquid channel configured to connect the second absorption layer and the cavity.

8. The printing apparatus according to claim 1, further comprising a measurement unit configured to measure a temperature of the transfer member cooled by liquid application by the application unit before the printhead discharges ink to the transfer member.

9. The printing apparatus according to claim 8, further comprising an adjustment unit configured to adjust at least one of a liquid application amount by the application unit, and a contact distance between the application unit and the transfer member, based on a temperature measured by the measurement unit.

10. The printing apparatus according to claim 9, wherein the liquid application amount by the application unit is adjusted by at least one of a temperature of the cleaning liquid, an amount of a liquid drawn up by a supplying roller of the application unit from a reservoir, a contact pressure between the supplying roller and the transfer member, and a relative velocity difference between the supplying roller and the transfer member.

11. The printing apparatus according to claim 1, further comprising a heating unit configured to heat the transfer member, wherein processing is repeated in an order of image formation by the printhead, heating by the heating unit, transfer by the transfer unit, liquid application by the application unit, and liquid collection by the collecting unit.

12. The printing apparatus according to claim 11, wherein the transfer member is a rotating body, and a surface of the transfer member is configured to move cyclically on a circular orbit, and wherein the printhead, the heating unit, the transfer unit, the application unit, and the collecting unit are arranged, in the order named, along a rotation direction of the transfer member, around the transfer member.

13. The printing apparatus according to claim 12, wherein the transfer member comprises a rotating drum, and wherein the printhead comprises a plurality of line heads, each line head being configured to print an image on a print medium, and the plurality of line heads are arranged radially along a columnar surface of the drum.

* * * * *